US005740702A

United States Patent [19]

Smith

[11] Patent Number: 5,740,702

[45] Date of Patent: Apr. 21, 1998

[54] DEVICE FOR SPINNING DRILL PIPE IN A DRILL RIG

[75] Inventor: Donald W. Smith, Garland, Tex.

[73] Assignee: Ingersoll-Rand Company, Woodcliff Lake, N.J.

[21] Appl. No.: 681,591

[22] Filed: Jul. 29, 1996

[51] Int. Cl.[6] ..... B25B 13/50

[52] U.S. Cl. ..... 81/57.33; 29/240

[58] Field of Search ..... 81/57.15, 57.2, 81/57.19, 57.33, 57.34, 57.44; 29/240

[56] References Cited

U.S. PATENT DOCUMENTS 4,076,337 2/1978 Childress ..... 81/57.2

4,092,881 6/1978 Jurgens et al. ..... 29/240

4,257,151 3/1981 Coots et al. ..... 29/240

4,843,924 7/1989 Hauk ..... 81/57.33

*Primary Examiner*—Robert C. Watson

*Attorney, Agent, or Firm*—John J. Selko

[57] ABSTRACT

A device for spinning vertical drill pipe on a drill rig includes a pair of opposed pipe gripping arms pivotably connected to the drill rig at a first end. The other end of one pipe gripping arm includes a drive wheel for frictionally contacting a drill pipe to be spun, and the other end of the second gripping arm includes a plurality of idler drive wheels to support the spinning pipe. A rod and cylinder assembly opens and closes the pipe gripping arms between a storage position and a pipe spinning position.

4 Claims, 4 Drawing Sheets

DEVICE FOR SPINNING DRILL PIPE IN A DRILL RIG

BACKGROUND OF THE INVENTION

This invention relates generally to drilling rigs, and more particularly to devices for spinning drill pipe during connection and disconnection of drill pipe in a drill string.

The process of pulling or installing drill pipe in a well is referred to as tripping in or out of the hole. In tripping of a well, the screwing apart or together of drill pipe, referred to as making or breaking the joint, is the most time consuming and labor intensive operation that is done by the driller and his helper. This operation requires the driller or helper to grab the drill pipe and physically rotate the pipe three to four complete turns in the direction desired while the pipe is hanging from the hoist line.

Currently, there are a number on devices available to speed the operation on making and breaking the pipe joint. These range from power tongs to pipe spinners and all of these devices suffer from one or more of the following operating problems or design deficiencies: 1. The device requires two or more hands to operate; 2. the device requires several steps for the operator to complete; 3. the device requires additional hoist or positioning equipment; 4. the drive wheel teeth damage the drill pipe; 5. the device cannot adjust to different pipe diameters; and 6. the device pushes drill pipe off center, causing misalignment of the pipe joint.

The foregoing illustrates limitations known to exist in present pipe spinning devices. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a pipe spinning device for spinning a drill pipe that is positioned on a drilling rig in a vertical plane comprising: a first elongated gripping arm having a first pivot end and a first pipe gripping end; a second elongated gripping arm having a second pivot end and a second pipe gripping end; first mounting means mounting the first pivot end on a support member, for pivoting the first gripping arm in a first plane substantially perpendicular to the drill pipe vertical plane; second mounting means mounting the second pivot end on a support member, for pivoting the second gripping arm in a second plane substantially parallel to the first plane; the first and second gripping arms being positioned with respect to each other to pivot alternatively toward and away from each other between a pipe gripping position and a gripping arm storage position, to cause the first and second gripping ends to alternatively move toward and away from each other; pipe spinning means on the first gripping end of the first gripping arm for frictionally contacting an outer surface of a pipe to rotatably spin the pipe about a rotation axis extending in the drill pipe vertical plane; pipe idler support means on the second gripping end of the second gripping arm for frictionally contacting an outer surface of a pipe to rotatably support the pipe as it spins about the rotation axis; and means for alternately moving the first and second gripping arms between the pipe gripping position and the gripping arm storage position.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
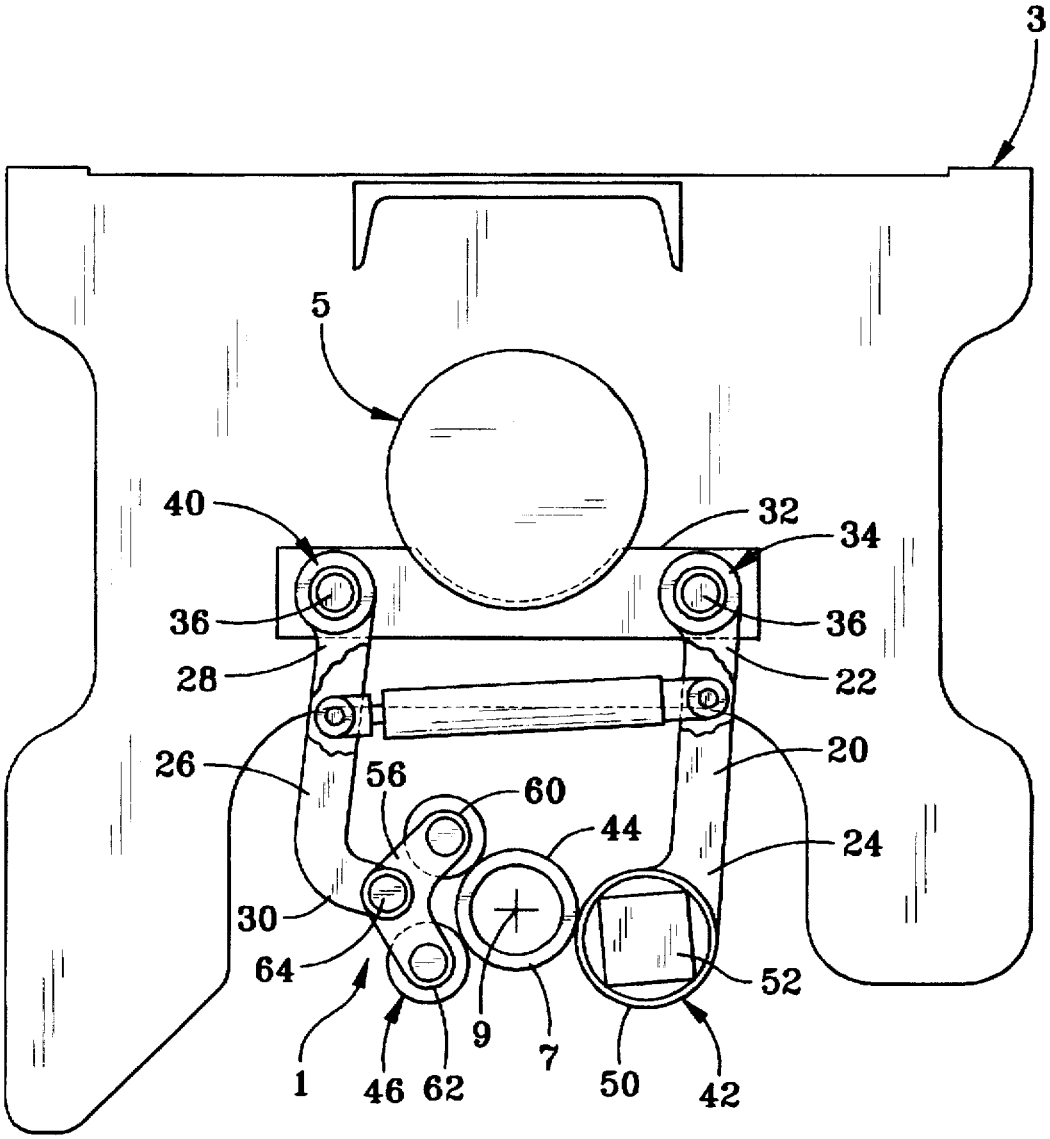
FIG. 1 is a schematic plan view of the pipe spinning device of the invention mounted on a drilling rig, with the device in the pipe spinning position.
Figure 2:
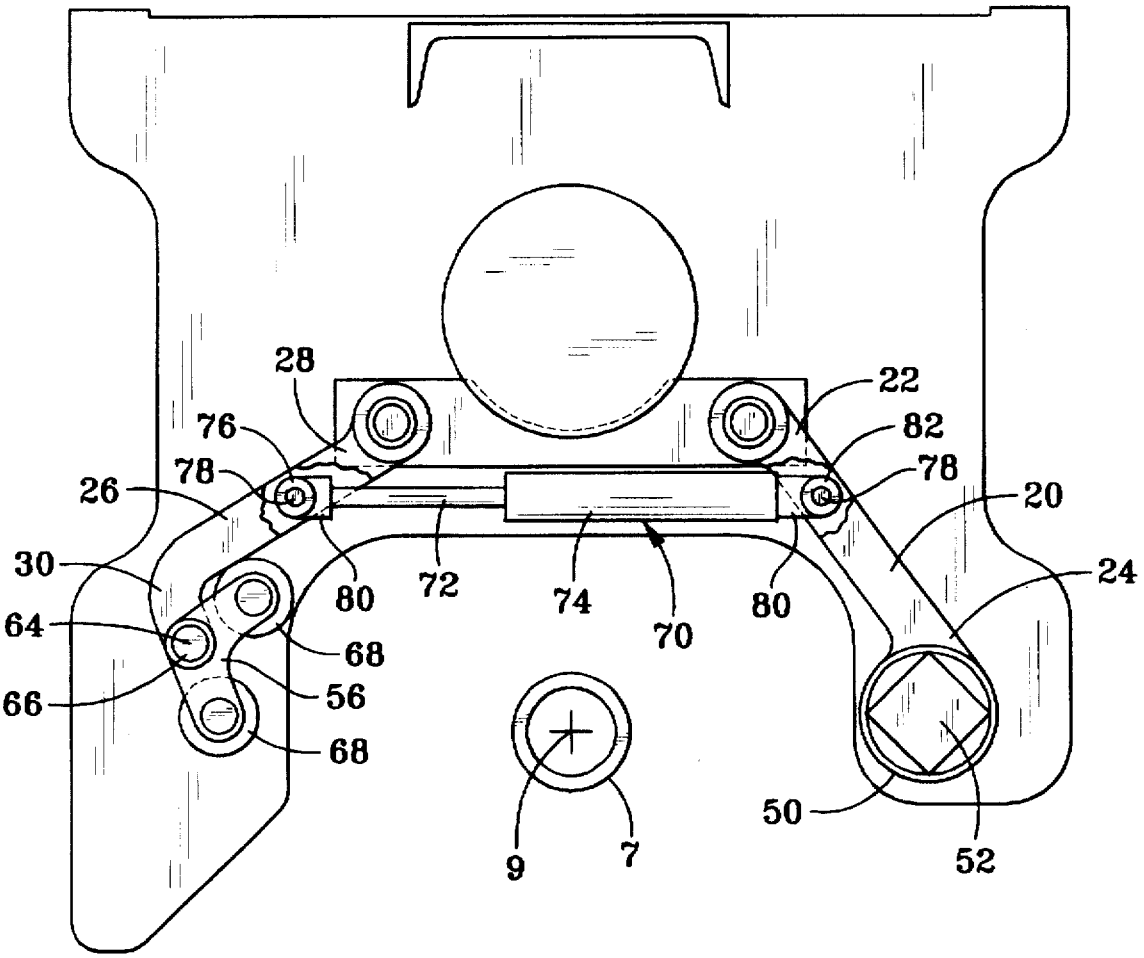
FIG. 2 is a schematic plan view of the pipe spinning device of the invention mounted on a drilling rig, with the device in the gripper arm storage position.

Referring to FIGS. 1 and 2, the pipe spinning device, shown generally as 1, is shown mounted on a conventional drilling platform or rig 3. A conventional carrousel driving mechanism, shown schematically as 5, positions a drill pipe 7 in a vertical plane above a drill hole position. During drilling, a plurality of drill pipes 7 will be screw threaded together to form a drill string, and later such drill pipes 7 will be disconnected, as the drill string is removed from the drill hole. Connection and disconnection of drill pipes 7 requires that individual drill pipes be rotated or spun a number of revolutions about axis of rotation 9.

The spinning device of this invention includes a plate member forming a first elongated gripping arm 20 having a first pivot end 22 and a first pipe gripping end 24. Another plate member forms a second elongated gripping arm 26 having a second pivot end 28 and a second pipe gripping end 30.

First gripping arm 20 is pivotally mounted to any convenient support member 32 on drilling platform 3 by first mounting means 34. First mounting means can be any conventional pivotable joint, such as a pivot pin 36 extending vertically through an aperture in first pivot end 22, and held in place by a nut (not shown) on an end of pivot pin 36. First gripping arm 20 can pivot back and forth in a first plane that is substantially perpendicular to the vertical plane of drill pipe 7.

Second gripping arm 26 is pivotally mounted to any convenient support member 32 on drilling platform 3 by second mounting means 40. Second mounting means 40 can be any conventional pivotable joint, such as a pivot pin 36 extending vertically through an aperture in second pivot end 28, and held in place by a nut (not shown) on an end of pivot pin 36. Second gripping arm 26 can pivot back and forth in a second plane that is substantially perpendicular to the vertical plane of drill pipe 7. The planes of pivot of first and second gripping arms 20, 26 can be coincident or vertically offset from each other.

Thus it can be understood that first and second gripping arms 20, 26 are positioned with respect to each other to pivot alternatively toward and away from each other between a pipe gripping position (FIG. 1) and a gripping arm storage position (FIG. 2), to permit first and second gripping ends 24, 30 to alternatively move toward and away from each other along an arcuate line of motion.

Pipe spinning means 42 is mounted on first gripping end 24 for frictionally contacting an outer surface 44 of pipe 7 to rotatably spin pipe 7 about axis 9. Pipe idler support means 46 is mounted on second gripping end 30 for frictionally contacting an outer surface 44 of pipe 7 to rotatably support pipe 7 as it spins about axis 9.

Pipe spinning means 42 includes a drive wheel means 50 rotatably mounted on first gripping end 24 for frictionally engaging outer surface 44 of pipe 7. Drive wheel means 50 is rotatable in a plane substantially parallel to the first pivot plane. A conventional hydraulic motor 52 mounted on first gripping end 24 rotates drive wheel means 50.

Pipe idler support means 46 includes a plate member forming an idler arm 56 mounted on second gripping end 30. Idler arm 56 is pivotable in a plane substantially parallel to first pivot plane. Idler arm 56 terminates in a first idler arm end 60 and a second idler arm end 62. Idler arm 56 is curved to space first idler arm end 60 and second idler arm end 62 apart from each other, as measured around an arcuate path around axis 9. Idler arm 56 pivots about a pivot axis 64 positioned between first and second idler arm ends 60, 62. Pivot axis 64 is formed by any conventional pivot connection, such as a pivot pin 66 extending through an aperture in idler arm 56, and held in place by a nut (not shown) on an end of pivot pin 66. First and second idler arm end 60, 62 each has rotatably mounted thereon an idler wheel 68 for frictionally engaging an outer surface 44 of pipe 7. Each idler wheel 68 is rotatable in a plane substantially parallel to the first pivot plane.

The device for alternately moving first and second gripping arms 20, 26 includes a hydraulic rod and cylinder assembly, shown generally as 70 positioned between first and second gripping arm 20, 26 in a generally horizontal plane. Rod 72 telescopically moves within cylinder 74, as is conventional. Rod 72 is pivotally connected at an external end 76 to second gripping arm 26 by means of any conventional pivot connection, such as a pivot pin 78 extending through rod 72, gripping arm 26 and a clevis member 80 on rod 72.

Cylinder 74 is pivotally connected at an external end 82 to first gripping arm 20 by means of any conventional pivot connection, such as a pivot pin 78 extending through gripping arm 20 and a clevis member 80 on cylinder 74.

Figure 3:
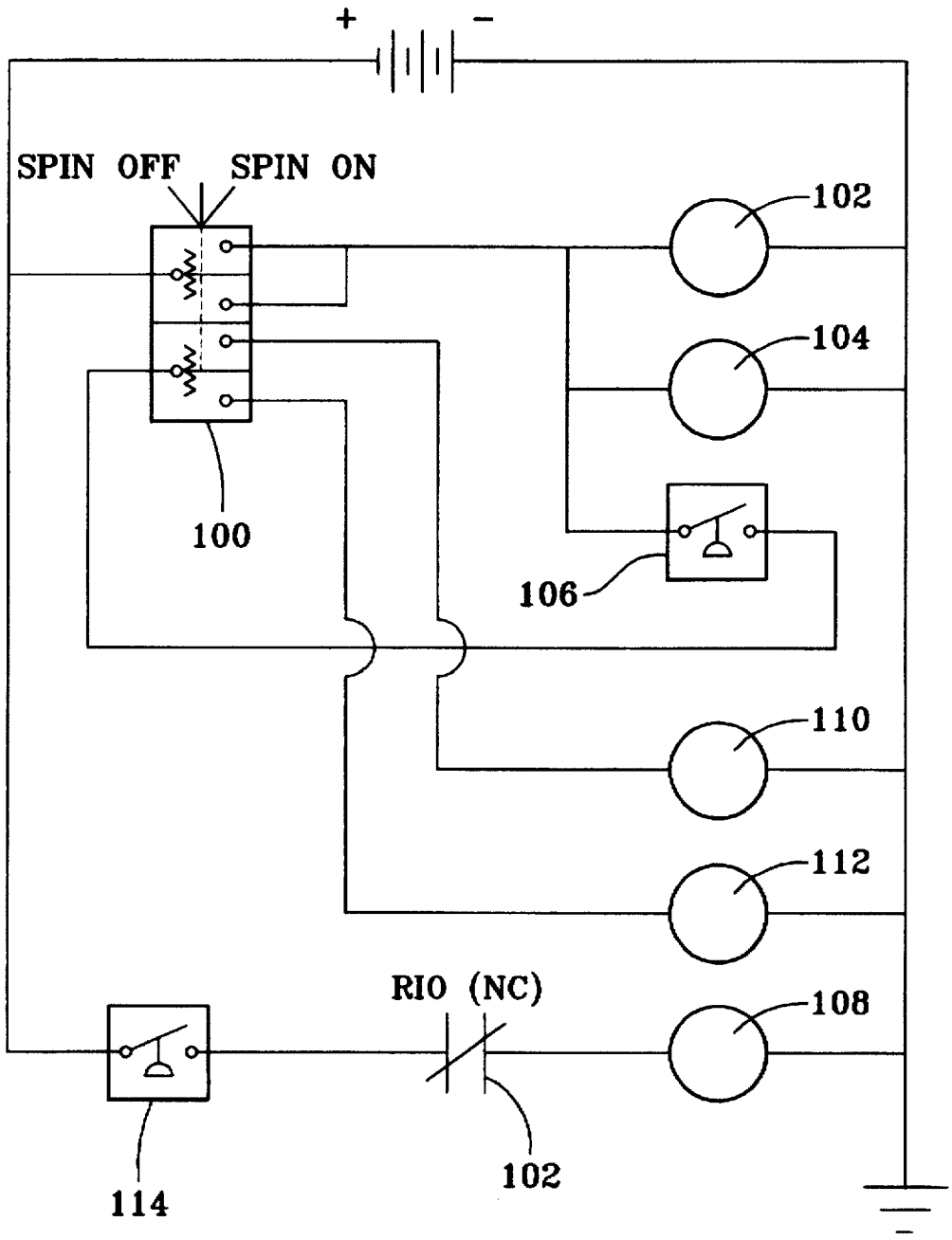
FIG. 3 is an exemplary schematic electrical diagram for actuating the device of the invention.
Figure 4:
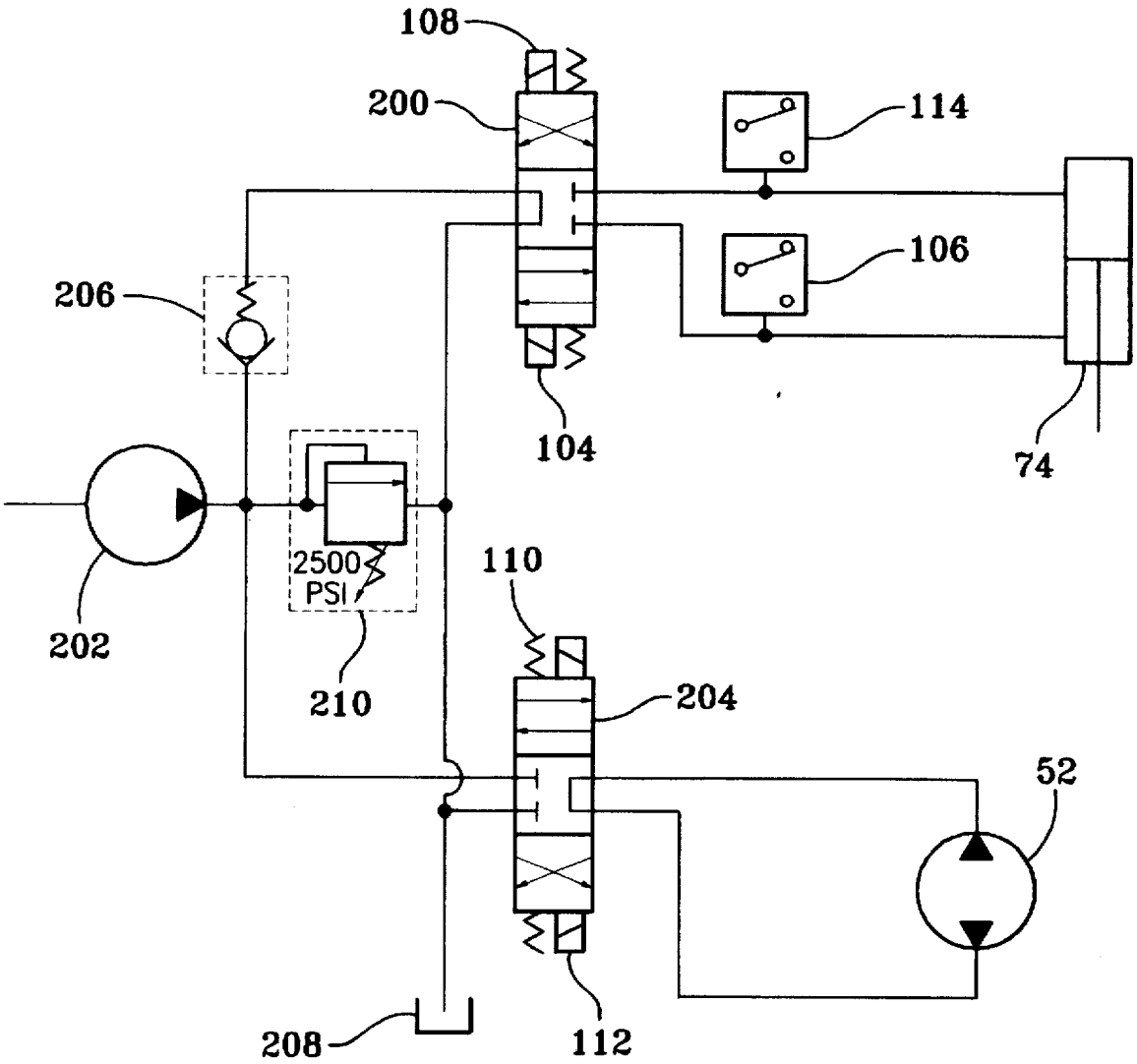
FIG. 4 is an exemplary schematic hydraulic circuit for actuating the device of the invention.

Referring to FIGS. 3 and 4, the actuation of rod and cylinder assembly 70 will be described. Beginning with the pipe spinner 1 in its stored position, a single electrical toggle switch 100, located in a control panel on rig 3, is activated. A 24VDC signal is applied to relay 102, solenoid 104 and pressure switch 106. The relay 102 opens its contact which insures solenoid 108 will remain de-energized through the engaged phase of operation. Solenoid 104 energizes, shifting the solenoid valve 200 (FIG. 4), allowing the hydraulic pump 202 to provide pressure to the rod end of hydraulic cylinder 74, which pulls the pipe gripping arms 20, 26 so that the drive and idler wheels 50, 68 come into contact with the drill pipe 7. When pressure in the rod end of the cylinder 74 reaches a preset level, the pressure switch 106 closes and supplies 24VDC to a second contact set on the toggle switch 100. This voltage is then supplied to either solenoid 110 or solenoid 112 depending on the direction that toggle Switch 100 was moved, to make or break the pipe joint. Solenoid 110 and solenoid 112 will cause solenoid valve 204 to shift allowing pressure to the drive motor 52 rotating it in the desired direction. When solenoid valve 204 shifts, it causes a small drop in pressure in the rod end of hydraulic cylinder 74. With this pressure drop, check valve 206 closes and holds the pipe gripping arms 20, 26 locked in place against the drill pipe 7, while the drive motor 52 develops the torque to make or break the pipe joint.

Releasing the toggle switch 100 allows it to return to center, cutting off the voltage to the relay 102, solenoid 104), and pressure switch 106. The relay 102 contacts are open when toggle switch 100 is activated and prevents 24VDC from passing from pressure switch 114 to solenoid 108. The pressure switch 114 is set to close when hydraulic pressure in the barrel end of the cylinder 74 reaches 500 PSI. Pressure switch 114 then de-energizes and the hydraulic valve 200 shifts to the neutral center position allowing the hydraulic oil supplied by the hydraulic pump 202 to free flow through check valve 206 and valve 200 back to tank 208 without developing pressure and unnecessary horsepower.

In the gripping arm storage position, if pressure should drop below 500 PSI in the barrel end of the hydraulic cylinder 74, without the toggle switch 100 being moved, the pressure switch 114 will close and shift the hydraulic valve 200 which will repressurize the barrel end of the hydraulic cinder 74 to above 500 PSI, thus insuring that the pipe gripping arms 20, 26 will stay in the stored position when not activated by the toggle switch 100.

The pressure switch 106 connected to the barrel end of the hydraulic cylinder 74 is adjustable for limiting the clamping forces on the drill pipe 7. Minimizing the clamping force to only a little higher then necessary to make or break the drill pipe joints will reduce damage done to the surface of the drill pipe 7 by the drive wheel 50. A system relief valve is shown as 210.

Having described the invention, what is claimed is:

1. A pipe spinning device for spinning a drill pipe that is positioned on a drilling rig in a vertical plane comprising:

(a) a first elongated gripping arm having a first pivot end and a first pipe gripping end;

(b) a second elongated gripping arm having a second pivot end and a second pipe gripping end;

(c) first mounting means mounting said first pivot end on a support member, for pivoting said first gripping arm in a first plane substantially perpendicular to the drill pipe vertical plane;

(d) second mounting means mounting said second pivot end on a support member, for pivoting said second gripping arm in a second plane substantially parallel to said first plane;

(e) said first and second gripping arms being positioned with respect to each other to pivot alternatively toward and away from each other between a pipe gripping position and a gripping arm storage position, to cause said first and second gripping ends to alternatively move toward and away from each other;

(f) pipe spinning means on said first gripping end of said first gripping arm for frictionally contacting an outer surface of a pipe to rotatably spin the pipe about a rotation axis extending in the drill pipe vertical plane;

(g) pipe idler support means on said second gripping end of said second gripping arm for frictionally contacting an outer surface of a pipe to rotatably support the pipe as it spins about the rotation axis; and (h) means for alternately moving said first and second gripping arms between said pipe gripping position and said gripping arm storage position, including gripping arm control means comprising:

a. first control means for locking in place against said pipe said pipe spinning means and said pipe idler means, while simultaneously causing said pipe spinning means to develop torque;

b. second control means for controlling pipe gripping pressure applied to said pipe by said pipe spinning means and said pipe idler means, to reduce damage done to said outer surface of said pipe; and c. third control means for locking in said gripping arm storage position said first and second gripping arms.

2. The device of claim 1 wherein said pipe spinning means comprises:

(a) drive wheel means rotatably mounted on said first gripping end for frictionally engaging an outer surface of a drill pipe, said drive wheel means rotatable in a plane substantially parallel to said first and second planes, and (b) hydraulic motor means mounted on said first gripping end for rotating said drive wheel means.

3. The device of claim 2 wherein said pipe idler support means comprises:

(a) an idler arm mounted on said second gripping end, said idler arm pivotable in a plane substantially parallel to said first and second planes;

(b) said idler arm terminating in a first and second idler arm end, said idler arm curved to space said first and second idler arm end apart from each other as measured around an arcuate path, said idler arm having a pivot axis positioned between said first and second idler arm end; and (c) said first and second idler arm end each having rotatably mounted thereon an idler wheel means for frictionally engaging an outer surface of a drill pipe, said each idler wheel means rotatable in a plane substantially parallel to said first and second planes.

4. The device of claim 3 wherein said means for alternately moving said first and second gripping arms comprises:

(a) a hydraulic rod and cylinder assembly positioned between said first and second gripping arm, said rod telescopically movable within said cylinder, said cylinder pivotally connected at a barrel end to said first gripping arm, said rod pivotally connected at an external end to said second gripping arm;

(b) and means for actuating said rod and cylinder assembly.

* * * * *